US007734081B2

(12) United States Patent
Hwang et al.

(10) Patent No.: US 7,734,081 B2
(45) Date of Patent: Jun. 8, 2010

(54) GRINDING METHOD AND SYSTEM WITH NON-CONTACT REAL-TIME DETECTION OF WORKPIECE THINKNESS

(75) Inventors: Thong-Shing Hwang, Taichung (TW); Hsien-Yao Li, Taichung (TW); Oh-Chung Ho, Taichung (TW)

(73) Assignee: Feng Chia University, Taichung (TW)

( * ) Notice: Subject to any disclaimer, the term of this patent is extended or adjusted under 35 U.S.C. 154(b) by 854 days.

(21) Appl. No.: 11/633,974

(22) Filed: Dec. 5, 2006

(65) Prior Publication Data

US 2008/0132149 A1 Jun. 5, 2008

(51) Int. Cl.
*G06K 9/00* (2006.01)
*B24B 49/00* (2006.01)

(52) U.S. Cl. ..... 382/141; 382/146; 451/6

(58) Field of Classification Search ..... 382/141, 382/146, 199, 203, 206, 307; 125/3, 11.01, 125/11.04, 20; 451/6, 69
See application file for complete search history.

(56) References Cited

U.S. PATENT DOCUMENTS 4,054,010 A * 10/1977 Shipman ..... 451/159
4,839,994 A * 6/1989 Heesemann ..... 451/6

* cited by examiner

*Primary Examiner*—Daniel G Mariam
(74) *Attorney, Agent, or Firm*—Ohlandt, Greeley, Ruggiero & Perle, L.L.P.

(57) ABSTRACT

A grinding method includes the steps of: enabling an image-capturing device to capture a set of consecutive images containing a workpiece being ground by a grinding device; enabling an image-processing device to identify the workpiece from the images, to detect a top edge of the identified workpiece from a latest one of the images, to locate a set of image pixels that lie on the top edge of the workpiece, and to determine relative heights of the image pixels; and enabling a controlling device to control grinding operation of the grinding device with reference to the relative heights of the image pixels. A system that performs the grinding method is also disclosed.

34 Claims, 5 Drawing Sheets

GRINDING METHOD AND SYSTEM WITH NON-CONTACT REAL-TIME DETECTION OF WORKPIECE THINKNESS

BACKGROUND OF THE INVENTION

1. Field of the Invention

This invention relates to a grinding method and system, more particularly to a grinding method and system that detects thickness of and that grinds a workpiece in real time without direct physical contact with the workpiece.

2. Description of the Related Art

Grinding of workpieces, such as a watch casing, is typically performed manually by a laborer, which is very inefficient in terms of quality and productivity. Furthermore, dust produced during grinding of the workpiece poses threat to the health of the laborer.

SUMMARY OF THE INVENTION

Therefore, the object of the present invention is to provide a grinding method and system that can overcome the aforesaid drawbacks of the prior art.

According to one aspect of the present invention, a grinding method is to be implemented by a system that includes an image-capturing device, an image-processing device, a controlling device, and a grinding device. The grinding method comprises the steps of:

A) placing a workpiece on a platform of the grinding device;

B) enabling the controlling device to control grinding of the workpiece by the grinding device;

C) enabling the image-capturing device to capture a set of consecutive images containing the workpiece being ground by the grinding device;

D) through a motion detection algorithm, enabling the image-processing device to identify the workpiece from the images captured in step C);

E) enabling the image-processing device to detect a top edge of the workpiece identified in step D) from a latest one of the images captured in step C);

F) enabling the image-processing device to locate a set of image pixels, each of which lies on the top edge of the workpiece detected in step E);

G) enabling the image-processing device to determine relative heights of the image pixels located in step F); and H) enabling the controlling device to control relative movement between the platform and a grinding unit of the grinding device with reference to the relative heights of the image pixels determined in step G).

According to another aspect of the present invention, a system comprises a grinding device and a control unit. The grinding device is operable so as to grind a workpiece The control unit includes an image-capturing device, an image-processing device, and a controlling device. The image-capturing device is operable so as capture a set of consecutive images containing the workpiece being ground by the grinding device. The image-processing device is coupled to the image-capturing device, and is operable so as to identify the workpiece from the images captured by the image-capturing device through a motion detection algorithm, so as to detect a top edge of the workpiece from a latest one of the images captured by the image-capturing device, so as to locate a set of image pixels, each of which lies on the top edge of the workpiece detected thereby, and so as to determine relative heights of the image pixels located thereby. The controlling device is coupled to the image-processing device and the grinding device, and is operable so as to control grinding operation of the grinding device with reference to the relative heights determined by the image-processing device.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
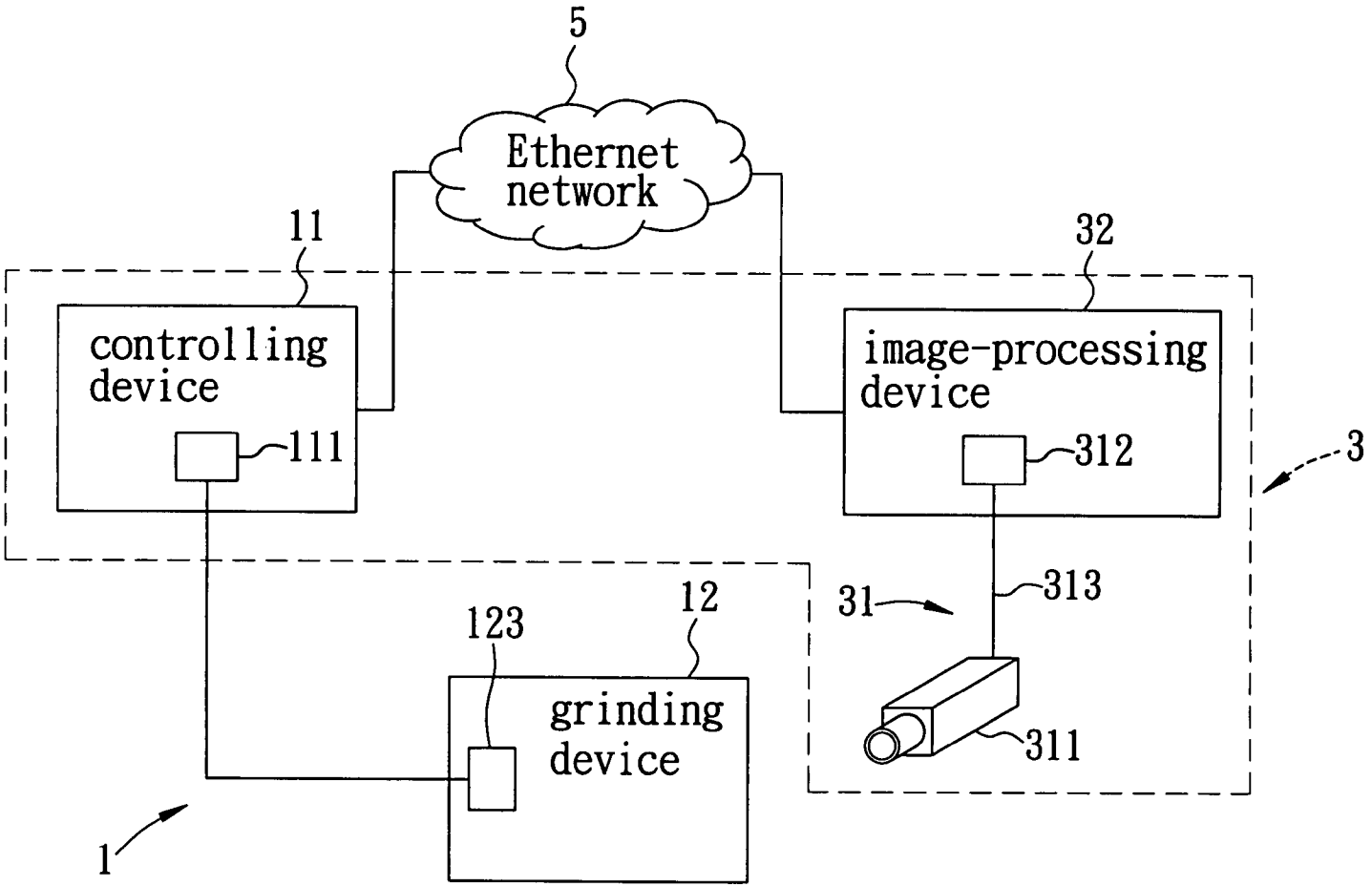
FIG. 1 is a schematic block diagram of the preferred embodiment of a system according to the present invention.
Figure 2:
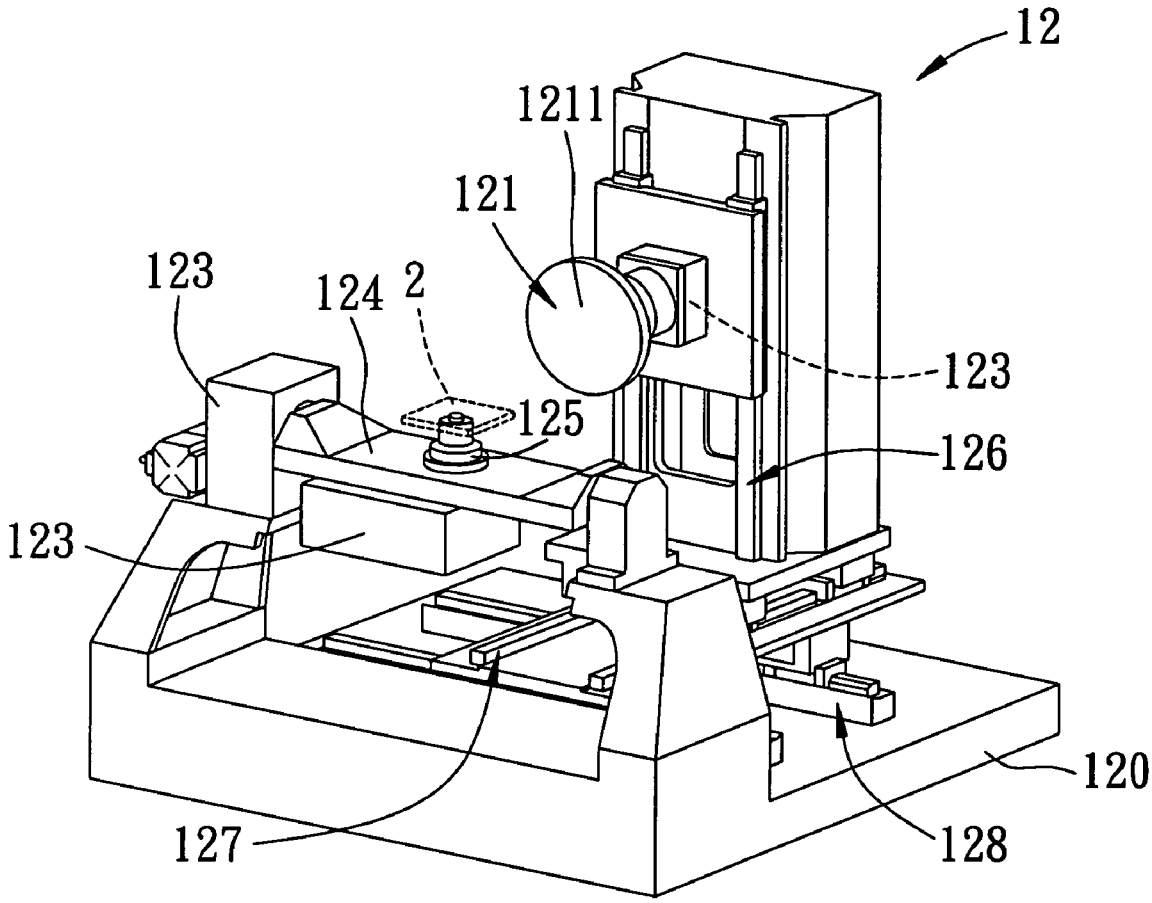
FIG. 2 is a perspective view of a grinding device of the preferred embodiment.

Referring to FIGS. 1 and 2, the preferred embodiment of a system 1 according to this invention is shown to include a grinding device 12 and a control unit 3.

The system 1 of this embodiment detects thickness of and processes, by grinding, a workpiece 2, such as a watch casing, in real time without direct physical contact with the workpiece 2, in a manner that will be described in greater detail hereinafter.

The grinding device 12 includes a base unit 120, a grinding unit 121, a platform 124, a rotating member 125, and a servo motor unit 123. The grinding unit 121 is mounted movably on the base unit 120, includes a grinding wheel 1211, and is movable relative to the base unit 120 in a vertical direction, a first horizontal direction transverse to the vertical direction, and a second horizontal direction transverse to the vertical direction and the first horizontal direction. The platform 124 is mounted movably on the base unit 120, and is movable relative to the base unit 120 in the vertical direction. The rotating member 125 is mounted rotatably on the platform 124, is rotatable relative to the platform 124 along a horizontal plane, and supports the workpiece 2 thereon. The servo motor unit 123 is operable so to drive movement of the grinding unit 121 and the platform 124 and so as to drive rotation of the rotating member 125.

The grinding device 12 further includes a pair of vertical rails 126 that guide movement of the grinding unit 121 in the vertical direction, a pair of first horizontal rails 127 that guide movement of the grinding unit 121 in the first horizontal direction, and a pair of second horizontal rails 128 that guide movement of the grinding unit 121 in the second horizontal direction.

The control unit 3 includes an image-capturing device 31, an image-processing device 32, and a controlling device 11.

The image-capturing device 31 includes a charge coupled device (CCD) camera 311, a video capture card 312, and a cable 313. The CCD camera 311 of the image-capturing device 31 is positioned at a fixed location relative to the grinding device 12, and is operable so as to capture a set of consecutive images containing the workpiece 2 being ground by the grinding wheel 1211 of the grinding unit 121. The cable 313, such as a R58A/U, connects the CCD camera 311 to the video capture card 312.

Figure 4:
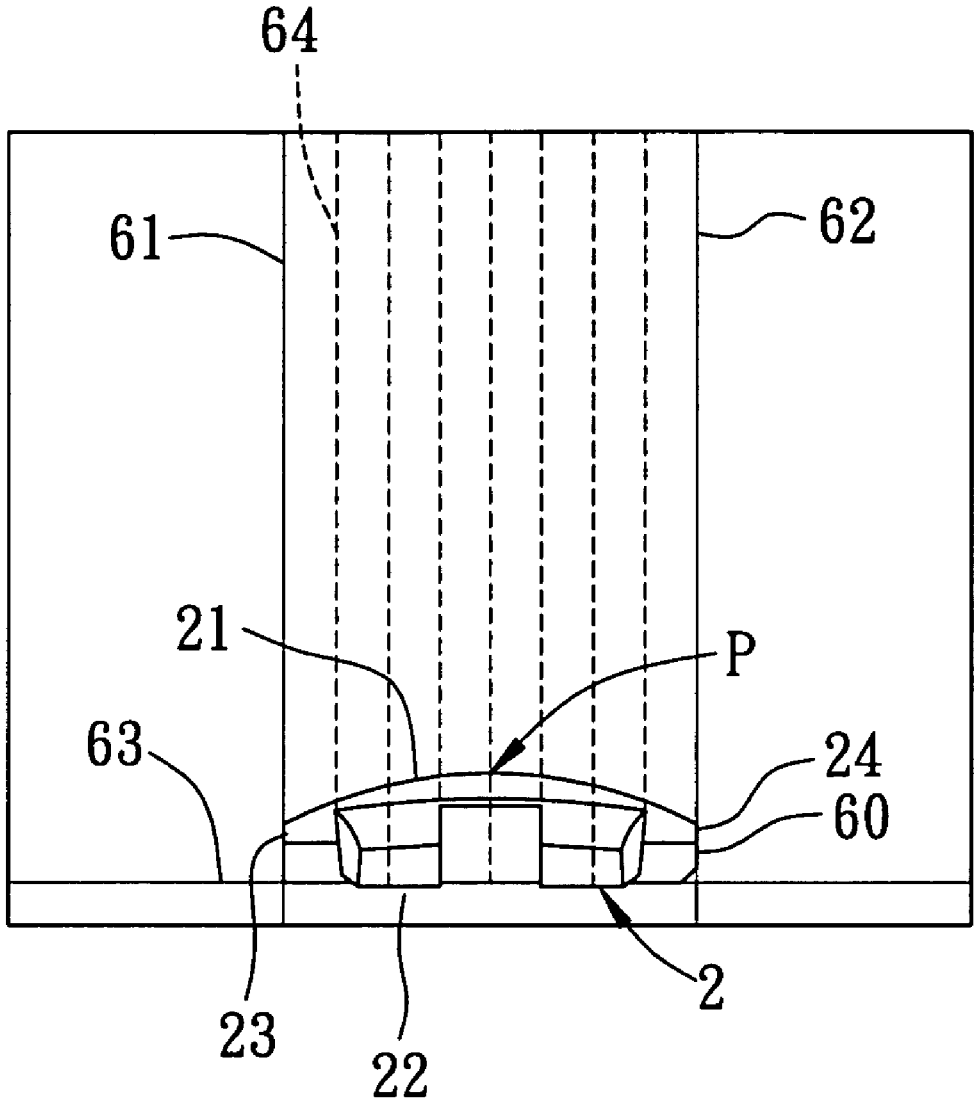
FIG. 4 is a schematic view of an image, which contains a workpiece, captured by an image-capturing device of the preferred embodiment.

The image-processing device 32 is implemented in a computer in this embodiment. The video capture card 312 of the image-capturing device 31 is installed in the image-processing device 32 in a known manner. In this embodiment, the image-processing device 32 is operable so as to identify the workpiece 2 (against a background) from the images captured by the CCD camera 311 of the image-capturing device 31 through a motion detection algorithm, so as to detect top, bottom, left and right edges 21, 22, 23, 24 (see FIG. 4) of the workpiece 2 identified thereby from a latest one of the images captured by the CCD camera 311 of the image-capturing device 31, so as to locate seven image pixels (P), each of which lies on the top edge 21 of the workpiece 2 detected thereby, and so as to determine relative heights of the image pixels (P) located thereby.

It is noted herein that the motion detection algorithm is based on a Markov Random Field (MRF) modeling. Although, a large amount of dust is produced during grinding operation of the grinding device 12, the motion detection algorithm is capable of identifying the workpiece 2 in such a harsh environment. Further, although the number of the image pixels (P) located by the image-processing device 32 is exemplified to be seven, the number of the image pixels (P) located by the image-processing device 32 may be increased or decreased in order to meet accuracy or speed requirement.

The controlling device 11 is implemented in a separate computer in this embodiment, is coupled to the servo motor unit 123 of the grinding device 12 through a controller card 111 installed therein, and is further coupled to the image-processing device 32 through an Ethernet network 5. In this embodiment, the controlling device 11 is operable so as to control grinding operation of the grinding device 12 with reference to the relative heights of the image pixels (P) determined by the image-processing device 32. That is, the controlling device 11 controls the servo motor unit 123 to drive relative movement between the platform 124 and the grinding unit 121 of the grinding device 12 in accordance with the relative heights of the image pixels (P) to thereby permit the grinding wheel 1211 of the grinding unit 121 to grind the workpiece 2 at appropriate positions.

It is noted that, in an alternative embodiment, the image-processing device 32 and the controlling device 11 are implemented in a single computer.

Figure 3A:
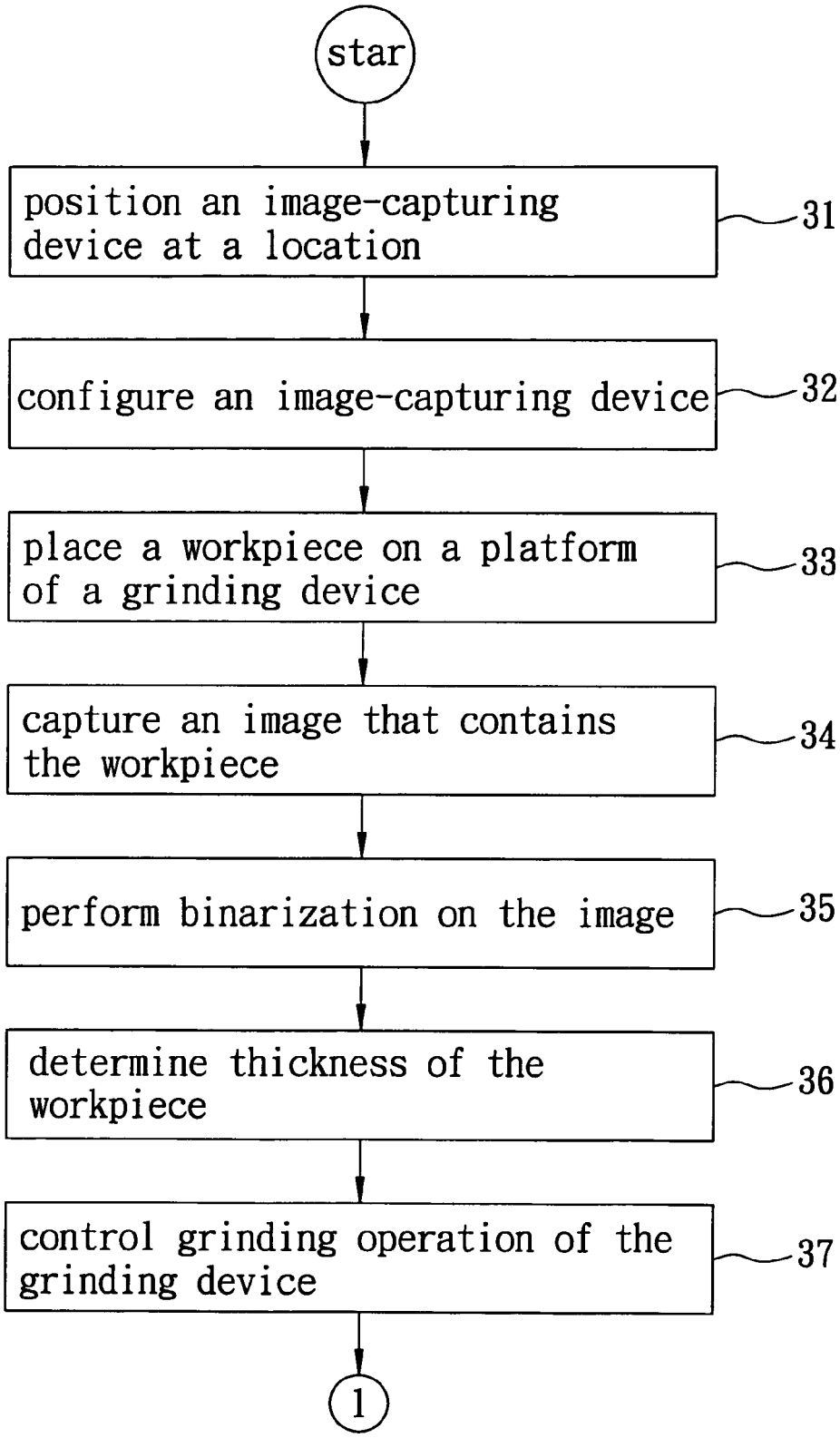
FIGS. 3A and 3B are flowcharts of the preferred embodiment of a grinding method according to the present invention.
Figure 3B:
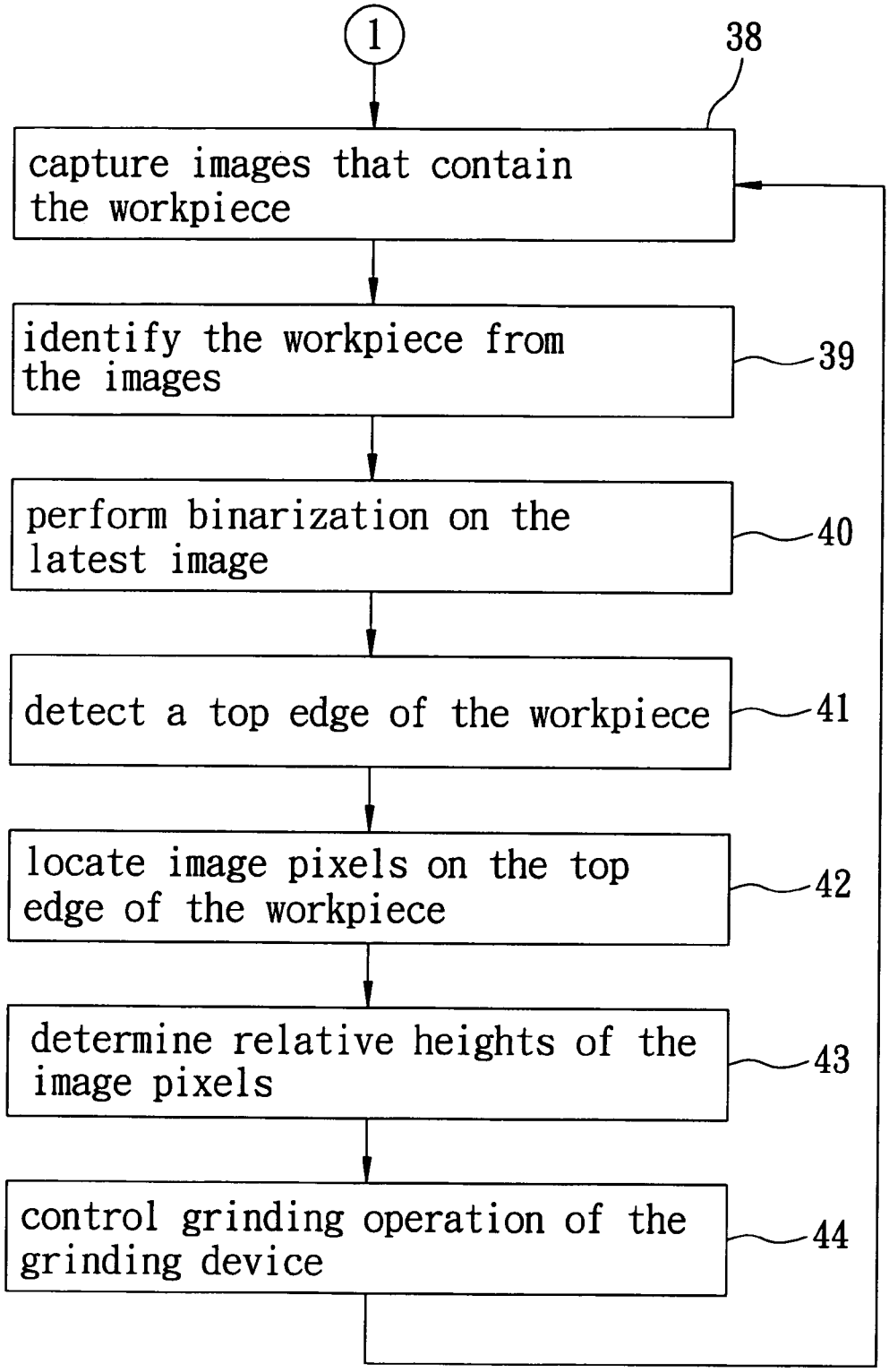

The preferred embodiment of a grinding method to be implemented by the aforementioned system 1 according to this invention includes the steps shown in FIGS. 3A and 3B.

In step 31, the CCD camera 311 of the image-capturing device 31 is positioned at a fixed location relative to the grinding device 12.

In step 32, the video capture card 312 of the image-capturing device 31 is configured with an image resolution.

In this embodiment, step 32 includes the sub-steps of:

sub-step 321) enabling the CCD camera 311 of the image-capturing device 31 to capture an image of a checkerboard (not shown); and sub-step 322) enabling the image-processing device 32 to determine the number of image pixels along a side of a square on the checkerboard from the image captured by the CCD camera 311 of the image-capturing device 31 in sub-step 321).

The video capture card 312 of the image-capturing device 31 is configured with the image resolution that is equal to the number of the image pixels determined by the image-processing device 32 in sub-step 322) per centimeter.

For example, when the number of the image pixels in sub-step 322) is determined to be sixty, the video capture card 312 of the image-capturing device 31 is configured with an image resolution of sixty image pixels per centimeter.

In step 33, the workpiece 2 is placed on the rotatable member 125, which is mounted on the platform 124, of the grinding device 12.

In step 34, the CCD camera 311 of the image-capturing device 31 captures an image that contains the workpiece 2 in a stationary state.

In step 35, the image-processing device 32 performs binarization on the image captured by the CCD camera 311 of the image-capturing device 31 in step 34.

In step 36, the image-processing device 32 determines thickness of the workpiece 2 based on the result of step 35.

In step 37, the controlling device 11 controls the grinding operation of the grinding device 12 with reference to the thickness determined by the image-processing device 32 in step 36.

In step 38, the CCD camera 311 of the image-capturing device 31 captures a set of consecutive images containing the workpiece 2 being ground by the grinding wheel 1211 of the grinding device 12.

In step 39, through the motion detection algorithm, the image-processing device 32 identifies the workpiece 2 from the images captured by the CCD camera 311 of the image-capturing device 31 in step 38.

Through the motion detection algorithm, since the workpiece 2 is moving while being ground, the background in the captured images can be filtered out accordingly. For more information on MRF-based motion detection algorithms, one may refer to a paper by C. Dumontier et al., entitled "Real time implementation of an MRF-based motion detection algorithm on a DSP board", Proc. 1996 IEEE Digital Signal Processing Workshop, pp. 183-186.

In step 40, the image-processing device 32 performs binarization on the latest one of the images captured by the CCD camera 311 of the image-capturing device 31 in step 38.

In step 41, the image-processing device 32 detects the top edge 21 of the workpiece 2 identified thereby in step 39 from the result of step 40.

In this embodiment, step 41 includes the sub-steps of:

sub-step 411) enabling the image-processing device 32 to locate a set of image pixels (P), each of which lies along the top edge 21 of the workpiece 2;

sub-step 412) enabling the image-processing device 32 to locate a boundary tracing window around each of the image pixels (P) located in sub-step 411); and sub-step 413) through an edge detection algorithm, enabling the image-processing device 32 to detect the top edge (P) of the workpiece 2 inside the boundary tracing windows located in sub-step 412). Preferably, the edge detection algorithm is based on Sobel.

In step 42, the image-processing device 32 locates seven image pixels (P), each of which lies on the top edge 21 of the workpiece 2 detected thereby in step 41.

In this embodiment, step 42 includes the sub-steps of:

sub-step 421) enabling the image-processing device 32 to locate a pair of vertical lines 61, 62, each of which is lies along a respective one of the left and right edges 23, 24 of the workpiece 2;

sub-step 422) enabling the image-processing device 32 to locate seven lines 64 that are parallel to and that are disposed between the left and right vertical lines 61, 62; and sub-step 423) enabling the image-processing device 32 to locate each of the seven image pixels (P) at an intersection between the top edge 21 of the workpiece 2 and a respective one of the seven lines 64.

In step 43, the image-processing device 32 determines relative heights of the image pixels (P) located in step 42.

In this embodiment, step 43 includes the sub-steps of:

sub-step 431) enabling the image-processing device 32 to locate a horizontal line 63 below the top edge of the workpiece 2. Preferably, the horizontal line 63 lies along the bottom edge of the workpiece 2;

sub-step 432) enabling the image-processing device 32 to count the image pixels between each of the image pixels (P) located in step 42 and the horizontal line 63 located in sub-step 431); and sub-step 433) enabling the image-processing device 32 to convert each number of the image pixels obtained in sub-step 432) into a unit of length.

It is noted that the image-processing device 32 performs the conversion with reference to the image resolution configured in the video capture card 312 of the image-capturing device 31. That is, for the exemplified image resolution of sixty image pixels per centimeter, when one of the numbers of the image pixels obtained in sub-step 432) is ninety, the corresponding length, i.e., height of the corresponding image pixel relative to the horizontal line 63, obtained in sub-step 432) should be 1.5 centimeters.

In step 44, the controlling device 11 controls grinding operation of the grinding device 12 by controlling the servo motor unit 123 of the grinding device 12 to drive relative movement between the platform 124 and the grinding unit 121 of the grinding device 12 with reference to the relative heights of the image pixels (P) determined by the image-processing device 32 in step 43. Thereafter, the flow goes back to step 38.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A grinding method to be implemented by a system that includes an image-capturing device, an image-processing device, a controlling device, and a grinding device, said grinding method comprising the steps of:

A) placing a workpiece on a platform of the grinding device;

B) enabling the controlling device to control grinding of the workpiece by the grinding device;

C) enabling the image-capturing device to capture a set of consecutive images containing the workpiece being ground by the grinding device;

D) through a motion detection algorithm, enabling the image-processing device to identify the workpiece from the images captured in step C);

E) enabling the image-processing device to detect a top edge of the workpiece identified in step D) from a latest one of the images captured in step C);

F) enabling the image-processing device to locate a set of image pixels, each of which lies on the top edge of the workpiece detected in step E);

G) enabling the image-processing device to determine relative heights of the image pixels located in step F); and H) enabling the controlling device to control relative movement between the platform and a grinding unit of the grinding device with reference to the relative heights of the image pixels determined in step G).

2. The grinding method as claimed in claim 1, wherein, in step D), the motion detection algorithm is based on a Markov Random Field (MRF) modeling.

3. The grinding method as claimed in claim 1, wherein step E) includes the sub-steps of:

e-1) enabling the image-processing device to locate a set of image pixels, each of which lies along the top edge of the workpiece;

e-2) enabling the image-processing device to locate a boundary tracing window around each of the image pixels located in sub-step e-1); and e-3) through an edge detection algorithm, enabling the image-processing device to detect the top edge of the workpiece inside the boundary tracing windows located in sub-step e-2).

4. The grinding method as claimed in claim 3, wherein, in sub-step e-3), the edge detection algorithm is based on Sobel.

5. The grinding method as claimed in claim 1, wherein step G) includes the sub-steps of enabling the image-processing device g-1) to locate a horizontal line below the top edge of the workpiece, g-2) to count the image pixels between each of the image pixels located in step F) and the horizontal line located in sub-step g-1), and g-3) to convert each number of the image pixels obtained in sub-step g-2) into a unit of length.

6. The grinding method as claimed in claim 5, further comprising the step of I) configuring the image-capturing device with an image resolution, wherein, in sub-step g-3), the image-processing device performs the conversion with reference to the image resolution configured in the image-capturing device.

7. The grinding method as claimed in claim 6, further comprising the step of positioning the image-capturing device at a fixed location relative to the grinding device prior to step I).

8. The grinding method as claimed in claim 1, wherein, prior to step B), said grinding method further comprises the steps of I) enabling the image-capturing device to capture an image that contains the workpiece in a stationary state, and J) enabling the controlling device to control the grinding device with reference to the image captured in step I).

9. The grinding method as claimed in claim 6, wherein the image resolution configured in the image-capturing device is sixty image pixels per centimeter.

10. The grinding method as claimed in claim 1, wherein, in step F), the image-processing device locates seven image pixels.

11. A method for non-contact real-time detection of workpiece thickness to be implemented by a system that includes an image-capturing device, an image-processing device, and a controlling device, said method comprising the steps of:

A) enabling the image-capturing device to capture a set of consecutive images containing a workpiece being processed by a grinding device;

B) through a motion detection algorithm, enabling the image-processing device to identify the workpiece from the images captured in step A);

C) enabling the image-processing device to detect a top edge of the workpiece identified in step B) from a latest one of the images captured in step A);

D) enabling the image-processing device to locate a set of image pixels, each of which lies on the top edge of the workpiece detected in step C);

E) enabling the image-processing device to determine relative heights of the image pixels located in step D); and F) enabling the controlling device to control grinding operation of the grinding device with reference to the relative heights of the image pixels determined in step E).

12. The method as claimed in claim 11, wherein, in step B), the motion detection algorithm is based on a Markov Random Field (MRF) modeling.

13. The method as claimed in claim 11, wherein step C) includes the sub-steps of:

c-1) enabling the image-processing device to locate a set of image pixels, each of which lies along the top edge of the workpiece;

c-2) enabling the image-processing device to locate a boundary tracing window around each of the image pixels located in sub-step c-1); and c-3) through an edge detection algorithm, enabling the image-processing device to detect the top edge of the workpiece inside the boundary tracing windows located in sub-step c-2).

14. The method as claimed in claim 13, wherein, in sub-step c-3), the edge detection algorithm is based on Sobel.

15. The method as claimed in claim 11, wherein step E) includes the sub-steps of enabling the image-processing device e-1) to locate a horizontal line below the top edge of the workpiece, e-2) to count the image pixels between each of the image pixels located in step D) and the horizontal line located in sub-step e-1), and e-3) to convert each number of the image pixels obtained in sub-step e-2) into a unit of length.

16. The method as claimed in claim 15, further comprising the step of G) configuring the image-capturing device with an image resolution, wherein, in sub-step e-3), the image-processing device performs the conversion with reference to the image resolution configured in the image-capturing device.

17. The method as claimed in claim 16, further comprising the step of positioning the image-capturing device at a fixed location relative to the grinding device prior to step G).

18. The method as claimed in claim 11, wherein, prior to step B), said method further comprises the steps of G) enabling the image-capturing device to capture an image that contains the workpiece in a stationary state, and H) enabling the controlling device to control the grinding operation of the grinding device with reference to the image captured in step G).

19. The method as claimed in claim 16, wherein the image resolution configured in the image-capturing device is sixty image pixels per centimeter.

20. The method as claimed in claim 11, wherein, in step D), the image-processing device locates seven image pixels.

21. A system, comprising:

a grinding device operable so as to grind a workpiece; and a control unit including an image-capturing device operable so as capture a set of consecutive images containing the workpiece being ground by said grinding device, an image-processing device coupled to said image-capturing device, and operable so as to identify the workpiece from the images captured by said image-capturing device through a motion detection algorithm, so as to detect a top edge of the workpiece from a latest one of the images captured by said image-capturing device, so as to locate a set of image pixels, each of which lies on the top edge of the workpiece detected thereby, and so as to determine relative heights of the image pixels located thereby, and a controlling device coupled to said image-processing device and said grinding device, and operable so as to control grinding operation of said grinding device with reference to the relative heights determined by said image-processing device.

22. The system as claimed in claim 21, wherein the motion detection algorithm is based on a Markov Random Field (MRF) modeling.

23. The system as claimed in claim 21, wherein said image-capturing device includes a charge coupled device (CCD) camera that is positioned at a fixed location relative to said grinding device.

24. The system as claimed in claim 23, wherein said image-capturing device further includes a video capture card installed in said image-processing device, and a cable that connects said CCD camera to said video capture card.

25. The system as claimed in claim 21, wherein said image-processing device is further operable so as to locate a set of image pixels, each of which lies along the top edge of the workpiece, so as to locate a boundary tracing window around each of the image pixels, and so as to detect the top edge of the workpiece inside the boundary tracing windows through an edge detection algorithm, thereby permitting said image-processing device to detect the top edge of the workpiece from the latest one of the images captured by said image-capturing device.

26. The system as claimed in claim 25, wherein the edge detection algorithm is based on Sobel.

27. The system as claimed in claim 21, wherein said image-processing device locates seven image pixels.

28. A control unit for non-contact real time detection of workpiece thickness, comprising:

an image-capturing device configured to be positioned at a fixed location relative to a grinding device, and operable so as capture a set of consecutive images containing a workpiece being ground by the grinding device;

an image-processing device coupled to said image-capturing device, and operable so as to identify the workpiece from the images captured by said image-capturing device through a motion detection algorithm, so as to detect a top edge of the workpiece from a latest one of the images captured by said image-capturing device, so as to locate a set of image pixels, each of which lies on the top edge of the workpiece detected thereby, and so as to determine relative heights of the image pixels located thereby; and a controlling device coupled to said image-processing device and said grinding device, and operable so as to control grinding operation of the grinding device with reference to the relative heights determined by said image-processing device.

29. The control unit as claimed in claim 28, wherein the motion detection algorithm is based on a Markov Random Field (MRF) modeling.

30. The control unit as claimed in claim 28, wherein said image-capturing device includes a charge coupled device (CCD) camera that is positioned at a fixed location relative to the grinding device.

31. The control unit as claimed in claim 30, wherein said image-capturing device further includes a video capture card installed in said image-processing device, and a cable that connects said CCD camera to said video capture card.

32. The control unit as claimed in claim 28, wherein said image-processing device is further operable so as to locate a set of image pixels, each of which lies along the top edge of the workpiece, so as to locate a boundary tracing window around each of the image pixels, and so as to detect the top edge of the workpiece inside the boundary tracing windows through an edge detection algorithm, thereby permitting said image-processing device to detect the top edge of the workpiece from the latest one of the images captured by said image-capturing device.

33. The control unit as claimed in claim 32, wherein the edge detection algorithm is based on Sobel.

34. The control unit as claimed in claim 28, wherein said image-processing device locates seven image pixels.

* * * * *